US008733838B2

(12) United States Patent
Suprina

(10) Patent No.: US 8,733,838 B2
(45) Date of Patent: May 27, 2014

(54) FLOOR TRACK FOR SEATING SYSTEM

(76) Inventor: Scott Suprina, East Northport, NY (US)

( * ) Notice: Subject to any disclaimer, the term of this patent is extended or adjusted under 35 U.S.C. 154(b) by 261 days.

(21) Appl. No.: 13/134,400

(22) Filed: Jun. 7, 2011

(65) Prior Publication Data

US 2011/0298256 A1 Dec. 8, 2011

Related U.S. Application Data

(60) Provisional application No. 61/397,086, filed on Jun. 7, 2010.

(51) Int. Cl.
*A47C 1/124* (2006.01)

(52) U.S. Cl.
CPC ..... *A47C 1/124* (2013.01)
USPC ..... 297/248; 248/501

(58) Field of Classification Search
USPC ..... 297/248, 463.1, 463.2; 248/188.2, 248/188.9, 501; 16/42 T
See application file for complete search history.

(56) References Cited

U.S. PATENT DOCUMENTS 878,043 A * 2/1908 Chrisman ..... 248/616
915,345 A * 3/1909 Gould ..... 297/186
1,535,298 A * 4/1925 Drabinsky ..... 297/133
1,931,289 A * 10/1933 Hambrook et al. ..... 297/243
D194,974 S * 4/1963 Kasparian ..... D6/379
3,883,923 A * 5/1975 England ..... 16/42 R
4,595,164 A * 6/1986 Froutzis et al. ..... 248/429
5,692,715 A * 12/1997 Hertel ..... 248/188.8
5,725,188 A * 3/1998 Monteiro, Jr. ..... 248/188.4
D423,994 S * 5/2000 Helwig ..... D12/133
6,484,450 B1 11/2002 Suprina et al. ..... 52/8
6,769,738 B1 8/2004 Rivera, Jr. et al. ..... 297/232
6,925,760 B2 8/2005 Suprina ..... 52/9
7,111,902 B1 9/2006 Conner ..... 297/248
7,806,474 B2 * 10/2010 Wahl et al. ..... 297/248
8,011,707 B1 * 9/2011 Summers ..... 294/15

* cited by examiner

*Primary Examiner* — Peter Brown
(74) *Attorney, Agent, or Firm* — Sunstein Kann Murphy & Timbers LLP

(57) ABSTRACT

An apparatus for maintaining at least two seats in a vertical position and a predetermined distance between rows of the at least two seats. The apparatus includes at least two substantially flat base portions; and at least two support blocks mounted a predetermined distance from each other on an upper surface of each of the base portions, wherein the at least two support blocks define a hollow region for receiving a lower end portion of a leg of a seat to maintain the seat in a vertical position. The predetermined distance between the support blocks corresponds to a predetermined distance between rows of seats.

22 Claims, 2 Drawing Sheets

10
16
18
12
14
100
102
104

DETAIL A

20

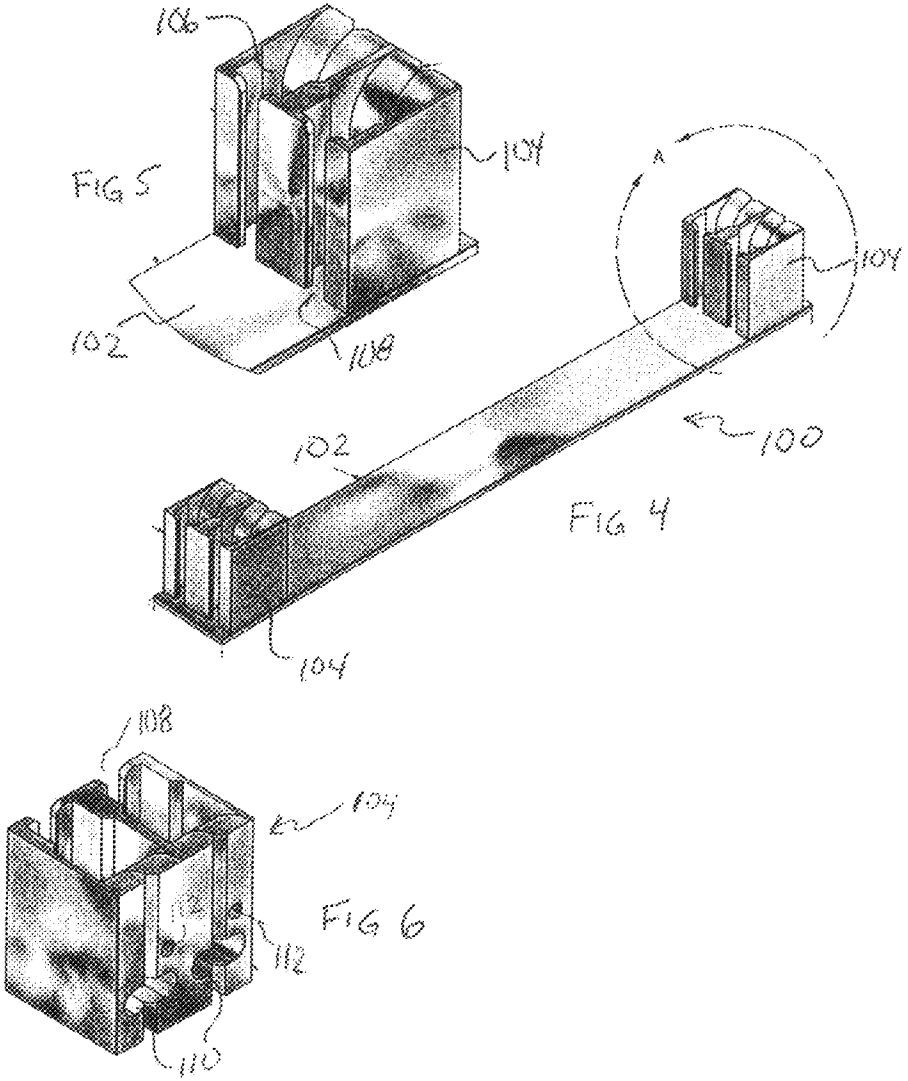
FIG 4
FIG 5
FIG 6
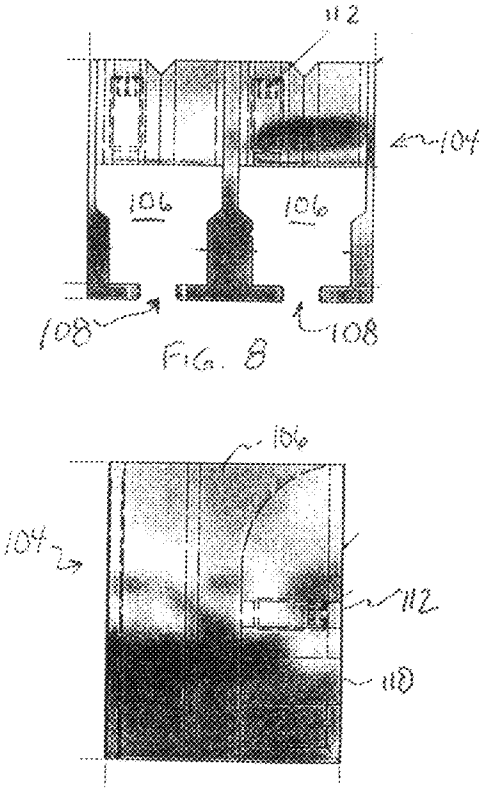
FIG. 8
FIG. 7

FLOOR TRACK FOR SEATING SYSTEM

CROSS-REFERENCE TO RELATED APPLICATIONS

This application claims the benefit of U.S. Provisional Patent Application No. 61/397,086, filed Jun. 7, 2010.

BACKGROUND OF THE INVENTION

1. Field of the Invention

The present invention relates to modular seating systems, and, more specifically, to floor tracks for use in a modular floor level seating system.

2. Description of the Background Art

Conventional floor level seating typically utilizes four legged folding chairs. Since these chairs are constantly in the open position when in position on the floor, standard folding chairs require a minimum of 34 or 36 inches of space between each row in order to comply with industry standards and regulations. Moreover, since these are individual chairs, they are susceptible to being moved around and therefore unlikely to maintain the required row spacing, thereby violating safety and fire codes.

In an attempt to reduce the mobility of the seats, attempts have been made to provide temporary indoor seating systems with groups of seats, typically two, three, four or five, with backs rests, that are ganged together or that are joined to a framework. However, the attachments for such systems are inconvenient to remove and reinstall. In addition, these indoor seating systems are typically not made for outdoor use.

Also, the groups of seats which are joined together still do not solve the problem of maintaining the correct amount of space between adjacent rows in accordance with safety and fire code regulations. That is, the entire group of chairs may be moved out of its original layout thereby decreasing the amount of space which is maintained between each row.

Accordingly, there is a need in the art for an apparatus which will maintain chairs in a desired configuration in compliance with the spacing requirements of safety and fire code regulations.

SUMMARY OF THE INVENTION

It is an object of the present invention to provide a novel system and apparatus that allows for a single leg stadium chair to be locked into a track at floor level. The floor track system of the present invention minimizes and maintains row spacing to a uniform minimum 30 inches of space between each row, thereby increasing the seating capacity in a given space, as compared to conventional seating. The floor tracks are preferably not required to be attached to the floor but may be attached to the floor. The floor tracks may also be installed in recesses formed in the floor. The floor tracks may be formed of various lengths to accommodate between two and any number of rows of seating. Preferably, the floor tracks are formed of a length to accommodate between two and five rows of seating. An alien set screw is preferably used to push against the back of the seat leg and thereby lock the seat leg within the floor track block, to hold the chairs in a vertical position and to eliminate unauthorized removal of the chairs from the floor track. A retaining pin is preferably used to prevent the chair from lifting out of the floor track block. The retaining pin is inserted through the chair and engages the floor track block. The retaining pin is easily removed to allow separation of the chair assembly from the floor track in a portable, temporary installation. Other hardware may be utilized. It is also contemplated that the chair assembly may be fixedly attached to the floor track for a more permanent type of installation.

The invention is not limited to the above-described embodiments, and various changes are possible without departing from the principles set forth herein.

The above is a brief description of some deficiencies in the prior art and advantages of the present invention. Other features, advantages and embodiments of the invention will be apparent to those skilled in the art from the following description of the drawings.

BRIEF DESCRIPTION OF THE DRAWINGS

The invention will become more clearly understood from the following detailed description in connection with the accompanying drawings, in which:

FIG. 4 is an isometric view illustrating a floor track assembly in accordance with an embodiment of the present invention;

FIG. 5 is an exploded view of detail A of FIG. 4 illustrating a partial floor track assembly in accordance with an embodiment of the present invention;

FIG. 6 is an isometric view illustrating a support block of a floor track assembly in accordance with an embodiment of the present invention;

FIG. 7 is side view illustrating a support block of a floor track assembly in accordance with an embodiment of the present invention; and FIG. 8 is top view illustrating a support block of a floor track assembly in accordance with an embodiment of the present invention.

DETAILED DESCRIPTION OF THE PREFERRED EMBODIMENTS

Figures 1, 2, 3:
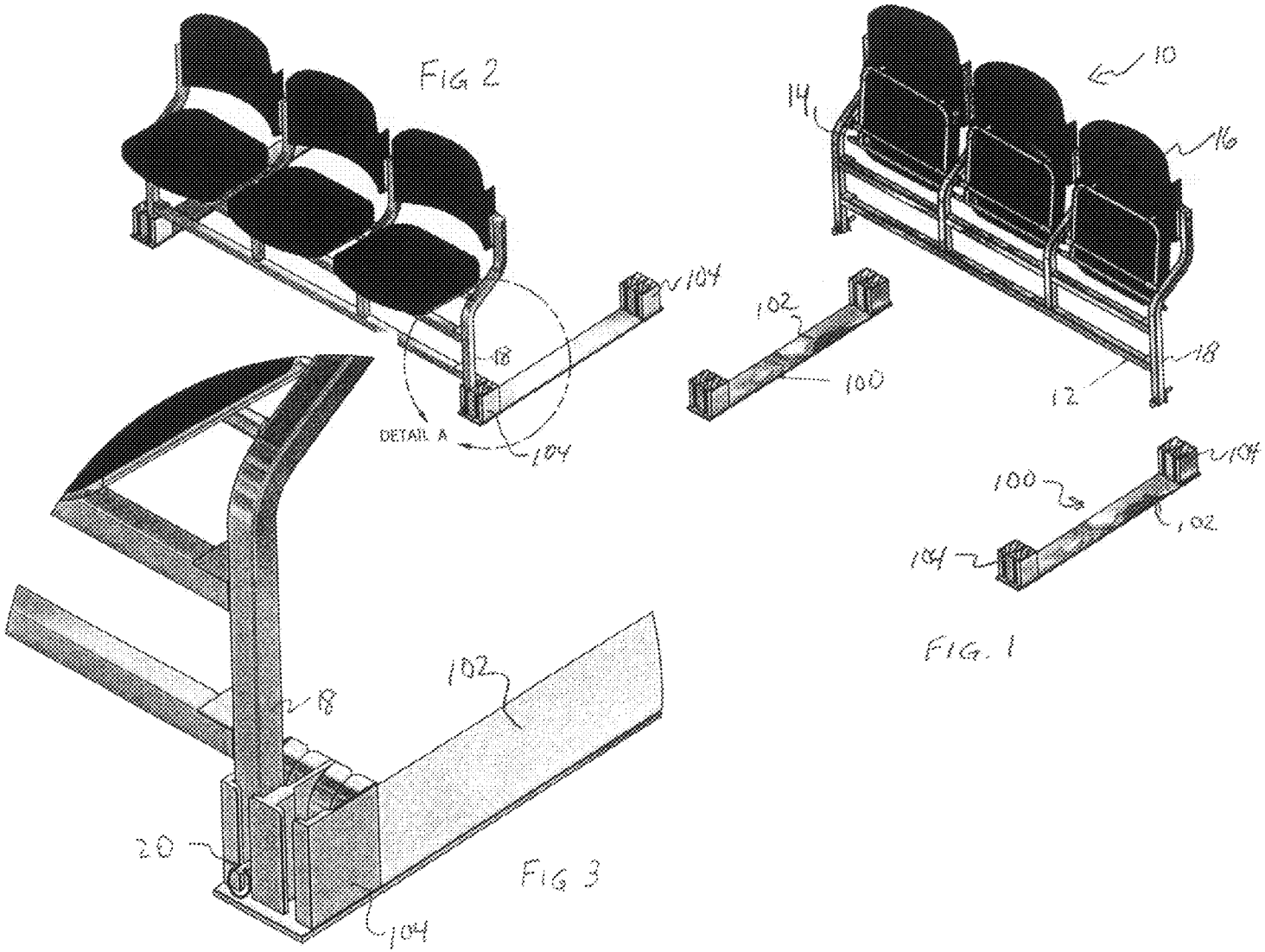
FIG. 1 is an isometric view illustrating a single leg triple flip seat assembly and two floor tracks accordance with an embodiment of the present invention.
FIG. 2 is an isometric view illustrating a single leg triple flip seat assembly having a leg in a support block of a floor track assembly in accordance with an embodiment of the present invention.
FIG. 3 is an exploded view of detail A of FIG. 2 illustrating a single leg triple flip seat assembly having a leg in a support block of a floor track assembly in accordance with an embodiment of the present invention.

The following description is presented to enable one of ordinary skill in the art to make and use the invention and is provided in the context of a patent application and its requirements. Various modifications to the preferred embodiments will be readily apparent to those skilled in the art and the generic principles herein may be applied to other embodiments. Thus, the present invention is not intended to be limited to the embodiment shown but is to be accorded the widest scope consistent with the principles and features described herein.

This invention describes a number of related components for use in creating an indoor/outdoor seating system, which can be assembled, disassembled and reconfigured efficiently while providing an attractive, safe and comfortable seating area, keeping code compliant in each configuration for a wide variety of spectator events indoors and out. The structural members and seat modules are optimally designed to be handled efficiently by a small crew who can hand carry the sections, if necessary, to areas where motorized access is not available.

FIG. 1 is an isometric view illustrating a single leg triple flip seat module 10 and two floor tracks 100 in accordance with an embodiment of the present invention. The three seat module 10 includes a structure which is a welded one-piece frame 12. Modules with two or more seats are practical. The three seat module 10 is easily handled by one worker. Flip-up seats typically use either gravity or a coil spring pivot on shafts 14 to lie flush with seat backs 16. While conventional construction requires a 36" wide row between seating rows with conventional folding chairs, the automatic flip-up design of the seating modules insures the requisite 12" walk-through clearance with only 30" wide rows. The use of factory-attached seats in modules and floor tracks reduces the labor and time involved in setting up the floor seating and prevents unauthorized movement and guarantees code compliance of the seating.

Although the embodiments that are illustrated show the use of a three seat module, it is contemplated that the floor tracks in accordance with the present invention may be utilized with any number of seats from one to a plurality.

The floor tracks 100 have a flat rectangular shaped base 102 and a pair of support blocks 104 attached to proximal and distal end sections of base 102. The blocks 104 extend upwardly from base 102 and are configured to engage a leg 18 of the seat assembly 10. On a horizontal floor application, the support blocks extend substantially perpendicular from the base 102. It is contemplated that the support blocks 104 may be configured to extend from base 102 at any given angle to maintain the chairs in a vertical position while accommodating a non-horizontal floor application.

FIG. 2 is an isometric view illustrating a single leg triple flip seat assembly having a leg 18 in a support block 104 of a floor track assembly 100 in accordance with an embodiment of the present invention.

FIG. 3 is an exploded view of detail A of FIG. 2 illustrating a single leg triple flip seat assembly 10 having a leg 18 in a support block 104 of a floor track assembly 100 in accordance with an embodiment of the present invention. Each floor track support block 104 is preferably formed having two regions for receiving legs 18 so that a plurality of seat modules may be strung adjacent to each other thereby providing strength and rigidity to the overall setup.

A locking pin 20 is illustrated for locking leg 18 to prevent the leg from slipping out of block 104 while in use. The locking pin 20 pin preferably consists of a key ring, a return spring and turned pin.

FIG. 4 is an isometric view illustrating a floor track assembly 100 in accordance with an embodiment of the present invention. The base section 102 is preferably formed of aluminum flat stock having approximate dimensions of ¼ inch by 4 inches by 34¼ inches long. The length of the base section will vary in accordance with the number of support blocks that are mounted thereon, which is a function of the number of rows of chairs each floor track will engage. That is, although the embodiments illustrated contain two support blocks mounted on the base section, it is contemplated that the base sections may vary in length to accommodate a plurality of equidistant spaced support blocks. Other materials of construction known to one having ordinary skill in the art may also be utilized to form base 102 or any other component. Support blocks 104 are also preferably milled from aluminum stock material and welded to base 102. The support blocks 104 may also be connected to base 102 by other means known to one having ordinary skill in the art.

FIG. 5 is an exploded view of detail A of FIG. 4 illustrating a partial floor track assembly 100 in accordance with an embodiment of the present invention. Each support block 104 preferably includes two adjacent regions 106 for receiving legs of seat modules. However, it is also contemplated that the support block 104 may be formed having only a single region 106 or a plurality of regions. Typically, in the embodiment of support block 104 shown, legs of two adjacent seat modules will be inserted into the regions 106. It is also contemplated that at the end of a row, when another seat module will not occupy the second region 106, the second region may be utilized for other applications such as, for example, insertion of a leg of a safety railing, or insertion of a post that can be used as a row sign.

The upper end of the support block adjacent to the opening of regions 106 is sloped down towards the region 106 to facilitate easy insertion of a seat leg into the open region 106 during the installation process. Longitudinal slots 108 are formed in support blocks 104 to receive a locking pin (shown in FIG. 3) extending from the seat leg as it is inserted into the support block 104. As the seat leg is inserted into the open region 106. The sloped portion depresses the locking pin until the leg is fully in the support block 104 and the spring loaded locking pin engages a hole to lock the leg within the support block.

FIG. 6 is an isometric view illustrating a support block 104 of a floor track assembly 100 in accordance with an embodiment of the present invention. The view of the support block 104 in FIG. 6 is of the opposite side of the support block 104 illustrated in FIG. 5. The two elongate holes 110 are formed to receive a locking pin to prevent a Seat leg from pulling out of the support block 104. Holes 112 are formed in support block 104 and have a threaded inner surface configured to receive a set screw therein. The purpose of the set screw is to further lock leg 18 within the support block 104, thereby minimizing the unauthorized removal of leg 18 from the support block 104 during use.

FIG. 7 is side view in partial cross-section illustrating a support block 104 of a floor track assembly 100 in accordance with an embodiment of the present invention. As the set screw is screwed into hole 112, the set screw will enter region 106 and engage a leg of a chair module and secure the leg within region 106.

FIG. 8 is top view in partial cross-section illustrating a support block 104 of a floor track assembly 100 in accordance with an embodiment of the present invention. The cross-section illustrates the position of the set screws within holes 112. The top view in FIG. 8 also illustrates the slot 108 and the shape, in cross-section, of region 106. It is contemplated that the shape and depth of region 106 may be altered to accommodate all types of chair configurations.

Advantageously, when more than one group of chairs 10 are positioned within the support blocks 104 on floor track assemblies 100, the chairs are restrained from moving side to side or front to back with respect to each other. Accordingly, the present invention provides an apparatus for supporting chairs in a manner which will maintain the chairs in their predisposed positions and spacing in accordance with safety and fire code regulations.

Fabric seat cushions are easily installed to enhance style and comfort that can be used to designate a general admission or VIP section. Seats can also be upgraded to a theatrical style upholstered chair with a choice of fabric with optional armrest and cup holders to maximize spectator comfort.

The present invention can also be easily installed in arenas which are not very accessible to trucks, or in rough outdoors terrain locations, where there is no drive-in access. With this system of the present invention, the installer's workers can hand carry the components effectively and therefore not be deterred by the fact that one can't drive a truck into the space or where one has to cross a distance of rough terrain land.

Although the present invention has been described in accordance with the embodiments shown, one of ordinary skill in the art will readily recognize that there could be variations to the embodiment and these variations would be within the spirit and scope of the present invention. Accordingly, many modifications may be made by one of ordinary skill in the art without departing from the spirit and scope of the invention.

What is claimed is:

1. An apparatus for maintaining at least two seats in a vertical position and a predetermined distance between rows of seats comprising:

an elongated substantially flat base portion; and at least two support blocks mounted a predetermined distance from each other in a longitudinal direction on an upper surface of the base portion, wherein each support block defines two hollow regions adjacent to each other in a widthwise direction of the base portion and configured to receive a lower end portion of a leg of a first seat in one of the two hollow regions and a lower end portion of a leg of a second seat in the other of the two hollow regions to support the first and second seats in a vertical position adjacent to each other to form a row of seats, so that each support block can support a row of seats with a predetermined distance between rows of seats.

2. The apparatus as recited in claim 1 wherein the base portion is formed of aluminum.

3. The apparatus as recited in claim 1 wherein the predetermined distance between the support blocks corresponds to a predetermined distance between rows of seats.

4. The apparatus as recited in claim 1 wherein at least one of the support blocks defines at least one hole in a side of the support block configured to receive a set screw therein.

5. The apparatus as recited in claim 1 wherein the at least two support blocks extend substantially perpendicular from an upper surface of the base.

6. The apparatus as recited in claim 1 wherein at least one of the first seat or the second seat is a seat module comprising at least two seats connected to each other.

7. The apparatus as recited in claim 1 wherein at least one of the support block define a longitudinal groove in a side of the support block to receive a locking pin assembly operatively connected to a leg received in a hollow region.

8. The apparatus as recited in claim 7 wherein the locking pin assembly comprises a key ring, a return spring and a turned pin.

9. The apparatus as recited in claim 1 wherein a wall of at least one support block is sloped down towards the hollow region to facilitate easy insertion of a seat leg into the hollow region during an installation process.

10. A combination floor track and seat assembly comprising: a floor track assembly having first and second elongated substantially flat base portions and at least two support blocks mounted a predetermined distance from each other in a longitudinal direction on an upper surface of each of the first and second base portions; at least two seat modules having at least one seat and two legs extending downward from the seat module, wherein each of the at least two support blocks defines two hollow regions adjacent to each other in a widthwise direction of the base portion and configured to receive a lower end portion of a leg of a first seat module in one of the two hollow regions and a lower end portion of a leg of a second seat module in the other of the two hollow regions to support the first and second seat modules in a vertical position adjacent to each other to form a row of seat modules, so that each support block can support a row of seats with a predetermined distance between rows of seats.

11. The apparatus as recited in claim 1, wherein the elongated base portion is a rectangular base portion.

12. The apparatus as recited in claim 10 wherein at least one of the seat modules comprises at least two seats connected together.

13. The apparatus as recited in claim 10 wherein at least one of the support blocks defines a longitudinal groove in a side of the support block to receive a locking pin assembly operatively connected to a leg received in a hollow region.

14. The apparatus as recited in claim 13 wherein the locking pin assembly comprises a key ring, a return spring and a turned pin.

15. The apparatus as recited in claim 10 wherein a wall of at least one support block is sloped down towards the hollow region to facilitate easy insertion of a seat leg into the hollow region during an installation process.

16. The apparatus as recited in claim 10 wherein the base portions are formed of aluminum.

17. The apparatus as recited in claim 10 wherein the predetermined distance between the support blocks corresponds to a predetermined distance between rows of the at least two seat modules.

18. The apparatus as recited in claim 10 wherein at least one of the support blocks defines at least one hole in a side of the support block configured to receive a set screw therein.

19. The apparatus as recited in claim 10 wherein at least one seat module includes at least one automatic flip-up seat.

20. A combination floor track and seat assembly comprising: a floor track assembly having first and second substantially flat base portions and at least two support blocks mounted a predetermined distance from each other on an upper surface of each of the first and second base portions; at least two seat modules having at least one seat and two legs extending downward from the seat module, wherein the at least two support blocks define a hollow region for receiving a lower end portion of at least one of the two legs of a seat module to maintain the seat module in a vertical position, and wherein the support blocks define a longitudinal groove in a side of the support blocks to receive a locking pin assembly operatively connected to the leg received in a hollow region.

21. The apparatus as recited in claim 20 wherein at least one of:

at least one of the seat modules comprises at least two seats connected together;

the locking pin assembly comprises a key ring, a return spring and a turned pin;

at least one of the seat modules includes at least one automatic flip-up seat;

the floor track assembly is formed of aluminum;

the predetermined distance between the support blocks corresponds to a predetermined distance between rows of the at least two seat modules;

the at least two support blocks define two hollow regions adjacent to each other and configured to receive a lower end portion of a leg of a first seat module in one of the two hollow regions and a lower end portion of a leg of a second seat module in the other of the two hollow regions to support the first and second seat modules in a vertical position adjacent to each other to form a row of seat modules;

the at least two support blocks define at least one hole in a side of the support blocks, wherein the at least one hole is configured to receive a set screw therein; or a wall of at least one support block is sloped down towards the hollow region to facilitate easy insertion of a seat leg into the hollow region during an installation process.

22. An apparatus for maintaining at least two seats in a vertical position and a predetermined distance between rows of seats comprising:

an elongated substantially flat base portion; and at least two pairs of seat leg receptacles, the pairs of seat leg receptacles mounted a predetermined distance from each other in a longitudinal direction on an upper surface of the base portion, each pair of seat leg receptacles defining two hollow regions adjacent to each other in a widthwise direction of the base portion and configured to receive a lower end portion of a leg of a first seat in one of the two hollow regions and a lower end portion of a leg of a second seat in the other of the two hollow regions to support the first and second seats in a vertical position adjacent to each other to form a row of seats, so that each pair of seat leg receptacles can support a row of seats with a predetermined distance between rows of seats.

* * * * *